US006875000B2

(12) United States Patent
Bae et al.

(10) Patent No.: US 6,875,000 B2
(45) Date of Patent: Apr. 5, 2005

(54) RECIPROCATING COMPRESSOR

(75) Inventors: Gyoo-Jong Bae, Gyungsangnam-Do (KR); Seong-Yeol Hyeon, Gyungsangnam-Do (KR); Jang-Whan Kim, Gyungsangnam-Do (KR); Jong-Tae Heo, Gyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 35 days.

(21) Appl. No.: 10/276,912

(22) PCT Filed: May 25, 2001

(86) PCT No.: PCT/KR01/00883

§ 371 (c)(1),
(2), (4) Date: Nov. 20, 2002

(87) PCT Pub. No.: WO02/077454

PCT Pub. Date: Oct. 3, 2002

(65) Prior Publication Data

US 2003/0129069 A1 Jul. 10, 2003

(30) Foreign Application Priority Data

Mar. 23, 2001 (KR) ..... 2001-15255

(51) Int. Cl.[7] ..... F04B 17/04
(52) U.S. Cl. ..... 417/417; 417/416
(58) Field of Search ..... 417/363, 417, 417/415, 416, 212, 214; 62/6; 310/12

(56) References Cited

U.S. PATENT DOCUMENTS 3,910,729 A 10/1975 Jepsen et al. ..... 417/417
5,980,211 A 11/1999 Tojo et al. ..... 417/45
6,202,791 B1 * 3/2001 Oh et al. ..... 184/6.16
6,238,192 B1 * 5/2001 Lee ..... 417/417
6,409,484 B1 * 6/2002 Hyun ..... 417/417
6,435,842 B2 * 8/2002 Song ..... 417/363
6,571,917 B1 * 6/2003 Hyun ..... 184/6.16

* cited by examiner

*Primary Examiner*—Charles G. Freay
(74) *Attorney, Agent, or Firm*—Birch, Stewart, Kolasch & Birch, LLP

(57) ABSTRACT

A reciprocating compressor including: a closed container (10); a reciprocating motor (20) having stators and an armature (22) disposed in the air gap between the stators (21) and making a reciprocal movement; a compression unit (30) having a piston (31) combined with the armature (22) of the reciprocating motor and a cylinder fixed inside the closed container (10); a spring unit (50) elastically supporting the armature (22) of the reciprocating motor (20) in a movement direction; and a frame unit (100) supporting the reciprocating motor (20) and the compression unit (30) having a gas hole (111) at a suitable portion thereof. Accordingly, when the armature (22) of the reciprocating motor (20) makes a reciprocal movement, the gas is compressed at the end of the armature (22), so that an increase of a flow resistance is prevented. In addition, in occurrence of an over-stroke of the armature, as the step portion (112) makes a space to prevent the magnet from releasing or damaging, the reliability of the compressor is improved.

10 Claims, 8 Drawing Sheets

RECIPROCATING COMPRESSOR

This application is the national phase under 35 U.S.C. § 371 of PCT International Application No. PCT/KR01/00883 which has an International filing date of May 25, 2001, which designated the United States of America.

TECHNICAL FIELD

The present invention relates to a reciprocating compressor, and more particularly, to a reciprocating compressor that is capable of reducing a flow resistance occurring when a piston makes a reciprocal movement and preventing an armature from damaging in an occurrence of overstroke of the armature.

BACKGROUND ART

In general, a reciprocating compressor is to suck, compress, and discharge a gas while a piston makes a reciprocal movement within a cylinder.

FIG. 1 is a vertical-sectional view of a reciprocating compressor of a conventional art.

As shown in FIG. 1, the conventional reciprocating compressor includes a closed container 10 filled with a lubricant at its bottom and having a suction pipe (SP) and a discharge pipe (DP) communicating with each other therein, a reciprocating motor 20 fixed inside the closed container 10, a compression unit 30 installed in the closed container 10 and sucking, compressing and discharging a gas, a frame unit 40 supporting the reciprocating motor 20 and the compression unit 30, a spring unit 50 elastically supporting the armature of the reciprocating motor 20 in a movement direction and inducing a resonance, and a lubricant feed unit (not shown) mounted at the frame unit 40 and feeding a lubricant to the reciprocating motor 20 and the compression unit 30.

The reciprocating motor 20 includes a stator 21 consisting of an inner stator 21A and an outer stator 21B and an armature 22 inserted in an air gap between the inner stator 21A and the outer stator 21B and making a reciprocating movement along with a piston 31 (to be described).

The armature 22 includes a magnet support member 22A inserted in the air gap between the inner stator 21A and the outer stator 21B and combined with the piston 31 of the compression unit 30, and magnets 22B fixed at the outer circumferential surface of the magnet support member 22A at regular intervals so as to be positioned in the air gap between the inner stator 21A and the outer stator 21B.

The compression unit 30 includes the piston 31 making a reciprocal movement by being combined to the magnet support member 22A of the reciprocating motor 20, a cylinder 32 fixed at a front frame 41 (to be described) so that the piston 31 is slidably inserted thereto, and forming a compressive space 32*a* along with the piston 31, a suction valve 33 mounted at the front end of the piston 31, opening and closing a gas hole 31*b* of the piston 31 to limit suction of a gas, and discharge valve assembly 34 mounted at the front end face of the cylinder 32 to cover the compressive space and limit discharging of a compressed gas.

A gas flow passage 31*a* communicating with the suction pipe (SP) is formed long inside the piston 31 to a predetermined depth and a gas hole 31*b* is formed connected to the gas flow passage 31*a*, penetrating the front end face of the piston 31.

The frame unit 40 includes a front frame 41 supporting contacting the front side of the inner stator 21A and the outer stator 21B, with which the cylinder 32 is insertedly combined, a middle frame 42 supportedly contacting the rear side of the outer stator 21B, and a rear frame 43 combined with the middle frame 42 to support the rear end of an outer spring 52.

The spring unit 50 includes an inner spring 51 inserted at the outer circumference of the cylinder 32 in the axial direction so that both ends thereof are respectively supported at the front face of a combining portion of the magnet support member 22A and the piston 31 and at the corresponding inner face of the front frame 41, and an outer spring 52, both ends of which are respectively supported at the rear face of the combining portion of the magnet support member 22A and the piston 31 and a corresponding front face of the rear frame 43.

The operation of the conventional reciprocating compressor constructed as described above will now be explained.

When a power is applied to a winding coil 21C mounted at the outer stator 21B and a flux is generated between the inner stator 21A and the outer stator 21B, the armature 22 positioned at the air gap between the inner stator 21A and the outer stator 21B is moved in the flux direction to continuously make a reciprocal movement by virtue of the spring 50, and accordingly, the piston 31 combined with the armature 22 makes a reciprocal movement with the cylinder 32, so that the volume of the compressive space 32*a* is changed and a coolant gas is sucked into the compressive space 32*a*, compressed therein and discharged therefrom.

In the sucking stroke of the piston, the coolant gas is sucked into the closed container 10 through the suction pipe (SP), passes through a gas flow passage 31*a* and the gas hole 31*b* of the piston 31 and opens the suction valve 33 so as to be sucked into the compressive space 32*a*, and in a compression stroke of the piston, the gas is compressed to a predetermined pressure and then discharged through the discharge pipe (DP) by opening the discharge valve assembly 34. The series of processes are repeatedly performed.

However, the conventional reciprocating compressor has the following problem. That is, as shown in FIG. 2A, since the front frame 41 supporting the inner stator 21A and the outer stator 21B is closed, the compressed gas works as a flow resistance to the behavior of the armature 22 which is reciprocally moved. Thus, due to the flow resistance, the armature 22 fails to proceed to a desired position, resulting in that the stroke of the piston 31 is shortened, degrading an efficiency of the compressor.

In addition, as shown in FIG. 2B, in case where the front frame 41 supporting both the inner stator 21A and the outer stator 21B is disposed very close to the armature 22, when an overstroke of the armature 22 occurs, there is a high possibility that the armature 22 collides with the rear face of the front frame 41 to damage the magnet 22B or a flux leakage between the two stators 21A and 21B is increased. Meanwhile, in case where the front frame 41 supporting both the inner stator 21A and the outer stator 21B is disposed at a distance from the armature 22, the piston 31, the rear frame 43 and the closed container 10 should be lengthened, causing problems that the material expense of the high-priced magnet is increased, the compressor is enlarged.

DISCLOSURE OF THE INVENTION

Therefore, an object of the present invention is to provide a reciprocating compressor that is capable of reducing a flow resistance caused due to compression of a coolant gas generated at a place other than a compression unit when an armature is reciprocally moved.

Another object of the present invention is to provide a reciprocating compressor that is capable of preventing an armature from colliding with a frame in occurrence of an overstroke of the armature, reducing a flux leakage between an inner stator and an outer stator and accomplishing a compact size compressor.

To achieve these objects, there is provided a reciprocating compressor including: a closed container in which a suction pipe and a discharge pipe communicate with each other; a reciprocating motor having a stator which consists of an inner stator and an outer stator fixed with a predetermined air gap inside the closed container and an armature disposed in the air gap between the two stators and making a reciprocal movement; a compression unit having a piston combined with the armature of the reciprocating motor to make a reciprocal movement along with the armature and a cylinder fixed inside the closed container into which the piston is slidably inserted to form a compressive space; a spring unit elastically supporting the armature of the reciprocating motor in the movement direction of the armature and inducing a resonance; and a frame unit supporting the reciprocating motor and the compression unit and having a gas hole at a certain portion thereof.

To achieve the above objects, there is also provided a reciprocating compressor including: a closed container in which a suction pipe and a discharge pipe communicate with each other; a reciprocating motor having a stator which consists of an inner stator and an outer stator fixed with a predetermined air gap inside the closed container and an armature disposed in the air gap between the two stators and making a reciprocal movement; a compression unit having a piston combined with the armature of the reciprocating motor to make a reciprocal movement along with the armature and a cylinder fixed inside the closed container into which the piston is slidably inserted to form a compressive space; a spring unit elastically supporting the armature of the reciprocating motor in a movement direction and inducing a resonance; and a frame unit having a contact part simultaneously contacting each stator of the reciprocating motor to support the reciprocating motor and the compression unit and a noncontact part at which a step portion is formed concave

MODES FOR CARRYING OUT THE PREFERRED EMBODIMENTS

A reciprocating compressor in accordance with a preferred embodiment of the present invention will now be described with reference to the accompanying drawings.

Figure 1:
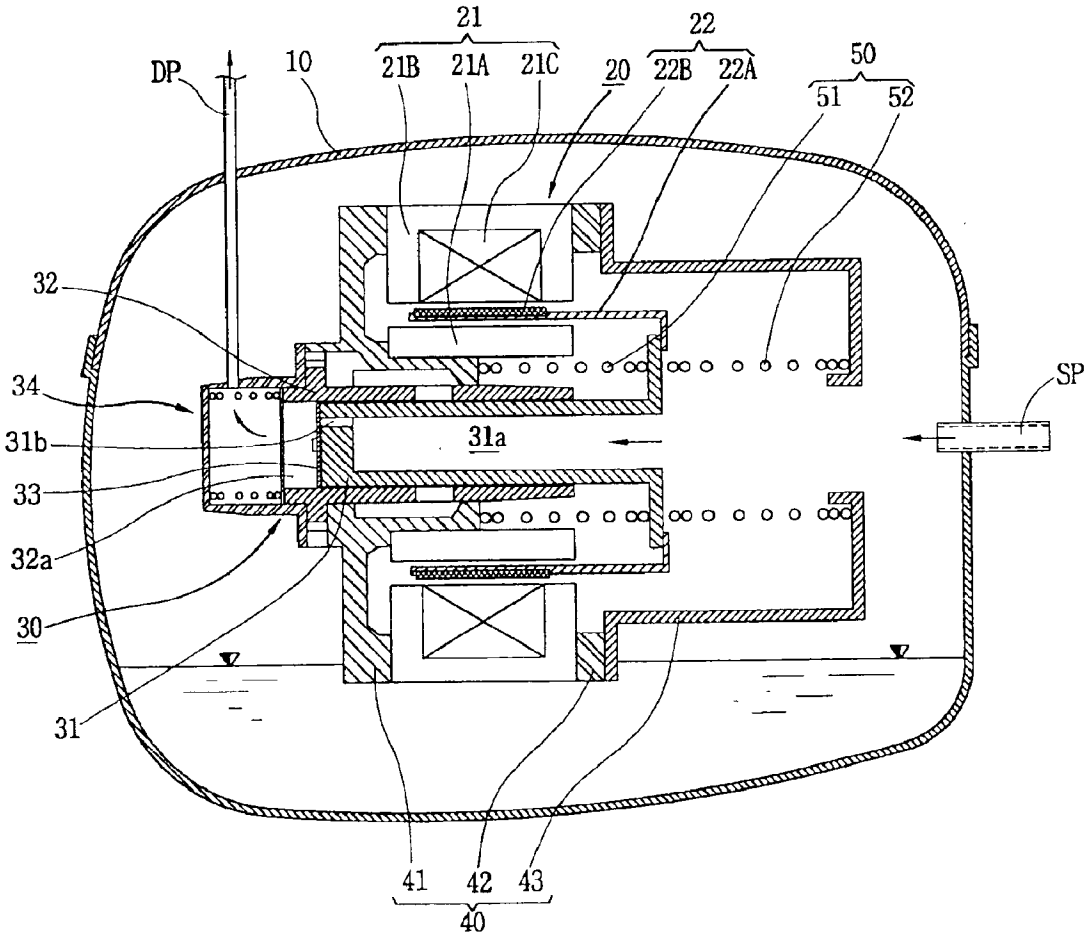
FIG. 1 BACKGROUND ART
FIG. 1 is a vertical-sectional view showing an example of a reciprocating compressor in accordance with a conventional art.
Figure 2A:
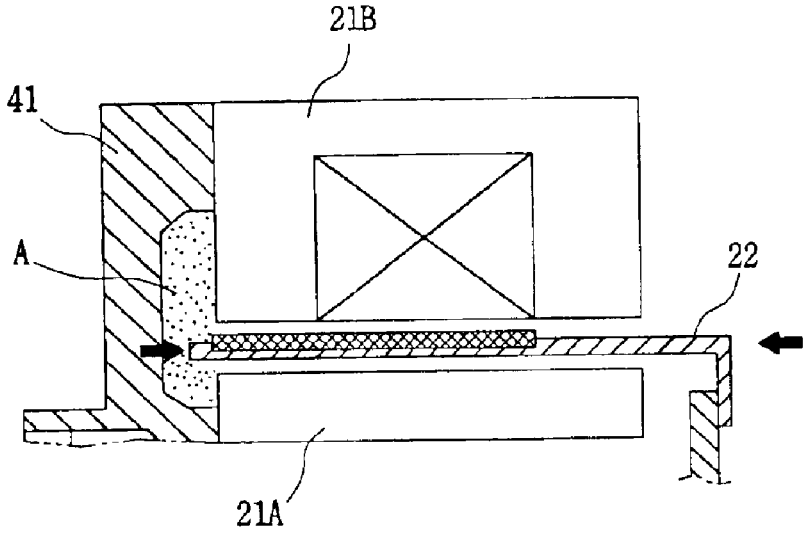
FIG. 2A BACKGROUND ART
FIG. 2A is a schematic sectional view showing an operational state of an armature of the reciprocating compressor in accordance with the conventional art.
Figure 2B:
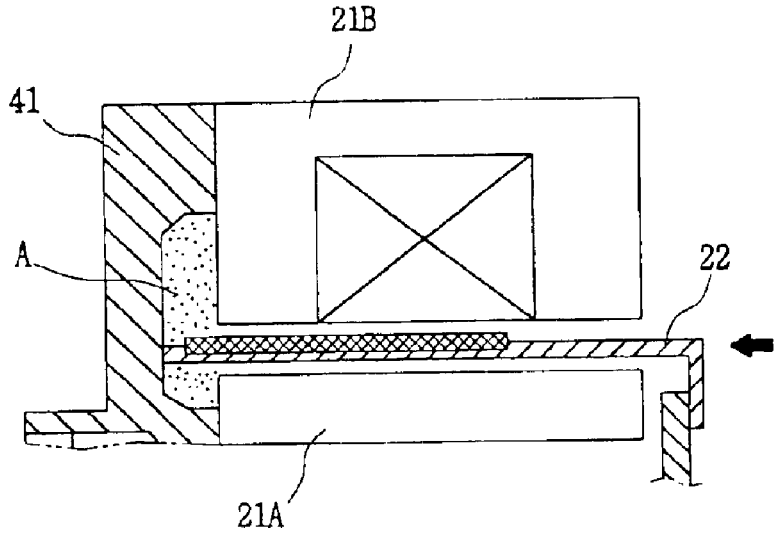
FIG. 2B BACKGROUND ART
FIG. 2B is a schematic sectional view showing an operational state of an armature of the reciprocating compressor in accordance with the conventional art.
Figure 3:
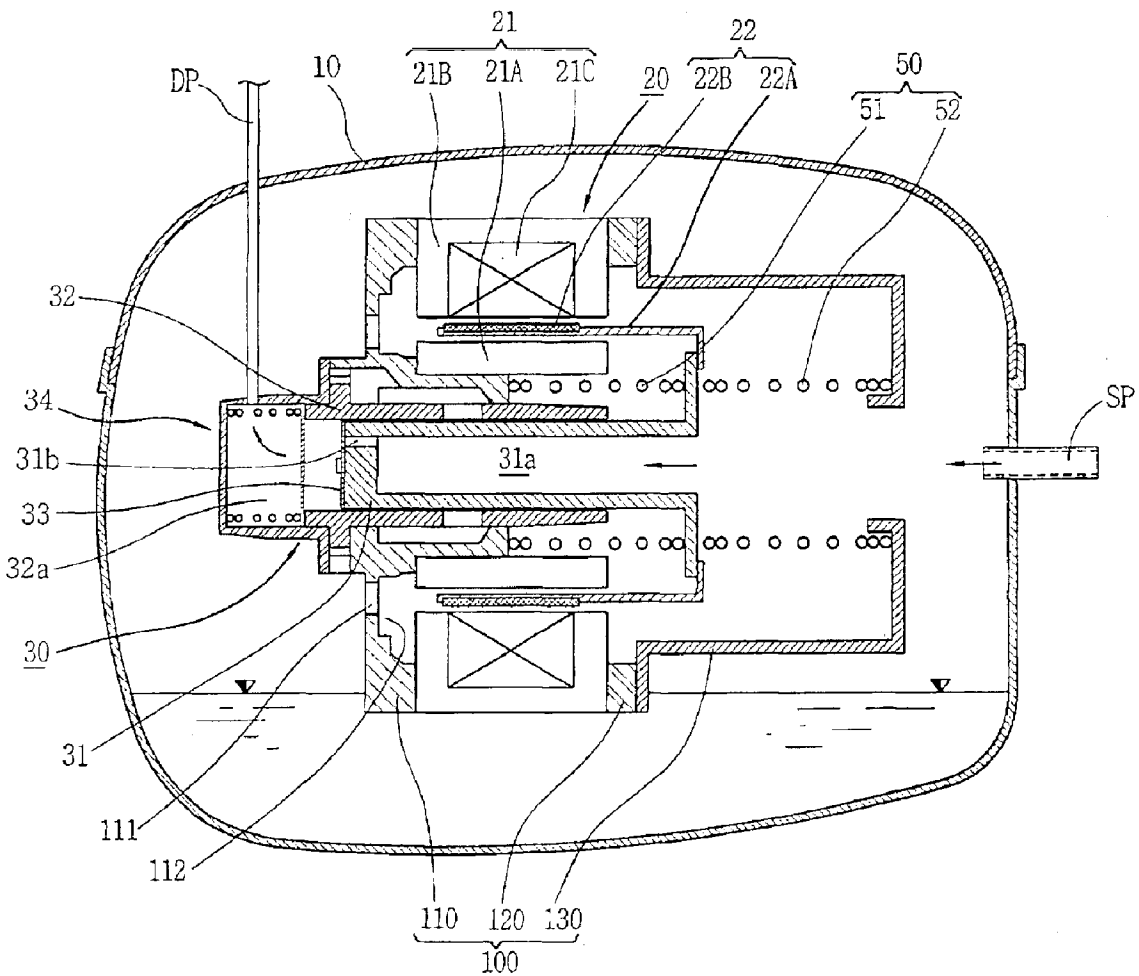
FIG. 3 is a vertical-sectional view showing an example of a reciprocating compressor in accordance with a preferred embodiment of the present invention.
Figure 4:
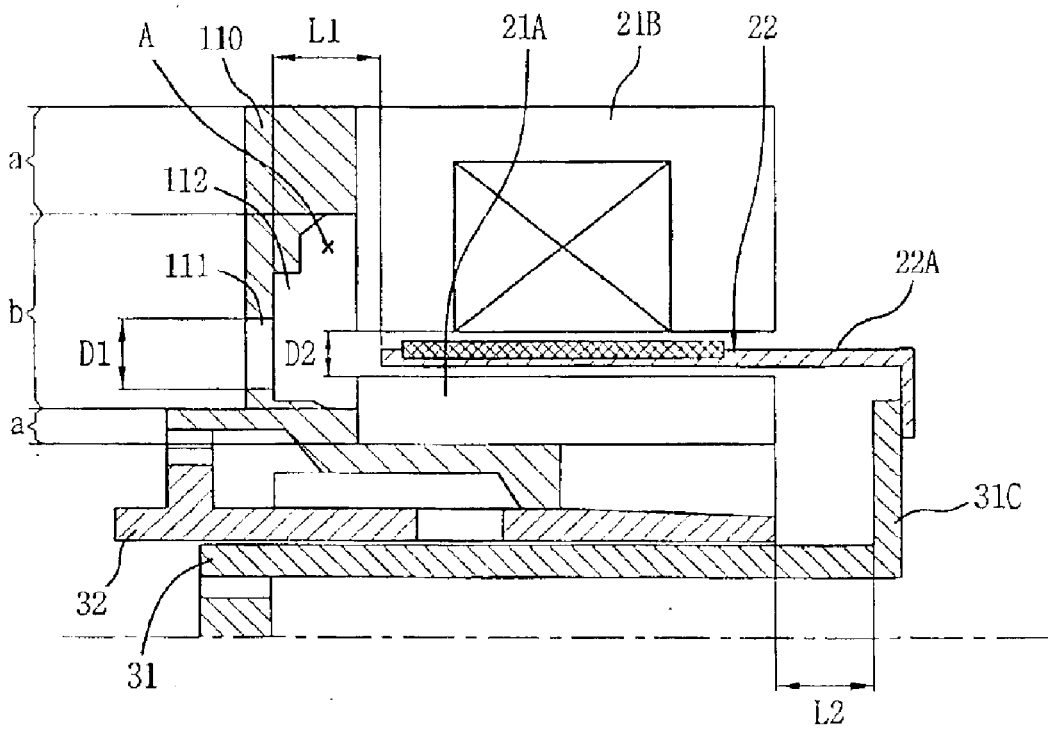
FIG. 4 is a schematic sectional view showing a major part of the reciprocating compressor in accordance with the preferred embodiment of the present invention.
Figure 5A:
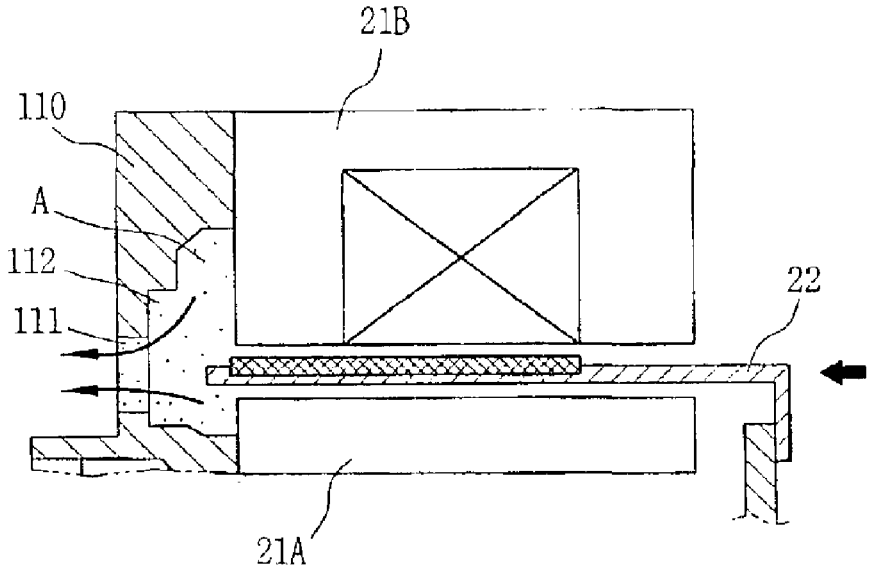
FIG. 5A is a schematic sectional view showing an operational state of an armature of the reciprocating compressor in accordance with the preferred embodiment of the present invention.
Figure 5B:
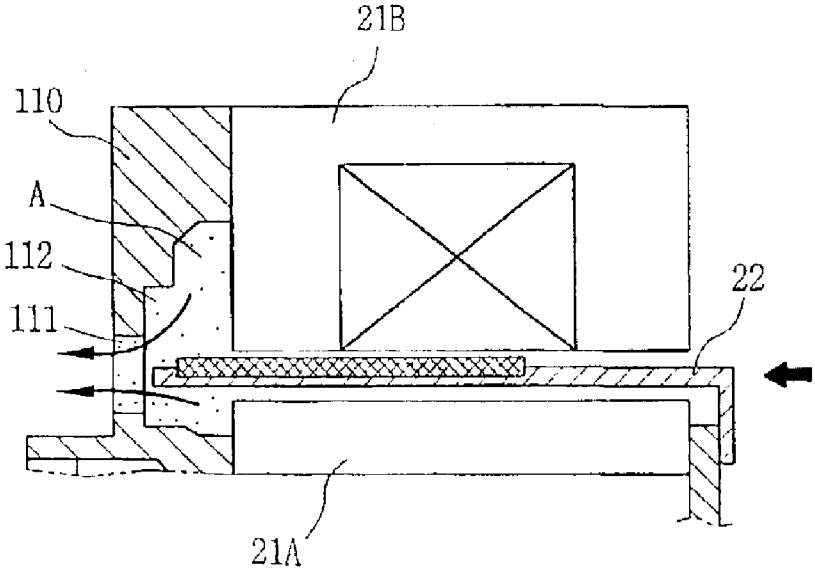
FIG. 5B is a schematic sectional view showing an operational state of an armature of the reciprocating compressor in accordance with the preferred embodiment of the present invention.

FIG. 3 is a vertical-sectional view showing an example of a reciprocating compressor in accordance with a preferred embodiment of the present invention, FIG. 4 is a schematic sectional view showing a major part of the reciprocating compressor in accordance with the preferred embodiment of the present invention, FIG. 5A is a schematic sectional view showing an operational state of an armature of the reciprocating compressor in accordance with the preferred embodiment of the present invention, and FIG. 5B is a schematic sectional view showing an operational state of an armature of the reciprocating compressor in accordance with the preferred embodiment of the present invention.

As shown in the drawings, a reciprocating compressor of the present invention includes a closed container 10 filled with a lubricant at its bottom and having a suction pipe (SP) and a discharge pipe (DP) communicating with each other therein, a reciprocating motor 20 fixed inside the closed container 10, a compression unit 30 installed in the closed container 10 and sucking, compressing and discharging a gas, a frame unit 100 supporting the reciprocating motor 20 and the compression unit 30, a spring unit 50 elastically supporting the armature of the reciprocating motor 20 in a movement direction and inducing a resonance, and a lubricant feed unit (not shown) mounted at the frame unit 100 and feeding a lubricant to the reciprocating motor 20 and the compression unit 30.

The reciprocating motor 20 includes a stator 21 consisting of an inner stator 21A and an outer stator 21B and an armature 22 inserted in an air gap between the inner stator 21A and the outer stator 21B and making a reciprocating movement along with a piston 31 (to be described).

The armature 22 includes a magnet support member 22A inserted in the air gap between the inner stator 21A and the outer stator 21B and combined with the piston 31 of the compression unit 30, and magnets 22B fixed at the outer circumferential surface of the magnet support member 22A at regular intervals so as to be positioned in the air gap between the inner stator 21A and the outer stator 21B.

The compression unit 30 includes the piston 31 making a reciprocal movement by being combined to the magnet support member 22A of the reciprocating motor 20, a cylinder 32 fixed at a front frame 110 (to be described) so that the piston 31 is slidably inserted thereto, and forming a compressive space 32*a* along with the piston 31, a suction valve 33 mounted at the front end of the piston 31, opening and closing a gas hole 31*b* of the piston 31 to limit suction of a gas, and discharge valve assembly 34 mounted at the front end face of the cylinder 32 to cover the compressive space and limit discharging of a compressed gas.

A gas flow passage 31*a* communicating with the suction pipe (SP) is formed long penetrating inside the piston 31 to a predetermined depth and a gas hole 31*b* is formed connected to the gas flow passage 31*a*, penetrating the front end face of the piston 31.

The frame unit 100 includes a front frame 110 supportingly contacting the front side of the inner stator 21A and the outer stator 21B, with which the cylinder 32 is insertedly combined, a middle frame 120 supportedly contacting the rear side of the outer stator 21B, and a rear frame 130 combined with the middle frame 120 to support the rear end of an outer spring 52.

With reference to FIG. 4, the front frame 110 is formed in a disk type having a through hole (without a reference numeral) at the center thereof into which the cylinder 32 is inserted. The front frame 110 includes a contact part (a) contacting both the inner stator 21A and the outer stator 21B and a noncontact part (b), which the inner stator 21A and the outer stator 21*b* do not contact, includes gas holes 111 formed on the same circumference.

The gas holes 111 are formed at a portion of facing the armature 22 in the movement direction in the air gap between the inner stator 21A and the outer stator 21B, and the diameter (D1) of the gas hole 111 is preferably the same as or greater than the interval (D2) of the air gap.

At the inner side of the front frame 110, a step portion 112, which has a ring shape when viewed from the front side, is formed concave, having an annular form when viewed from the front side, to prevent the end portion of the armature 22 from colliding with the inner face of the front frame 110 in occurrence of an overstroke of the armature 22.

The step portion 112 is formed at a portion where the gas hole 111 is formed of the inner face of the front frame 110 corresponding to the front end of the armature 22, that is, at the noncontact part (b) with a predetermined depth which does not contact the inner stator 21A and the outer stator 21B.

In order to avoid a possible collision between the armature 22 and the front frame 110 in occurrence of an overstroke of the armature 22, the distance (L1) from the bottom of the step portion 112 to the corresponding front end of the armature 22 is longer than the distance (L2) from the inner face of a flange part 31C where the armature 22 and the piston are combined with each other to the most adjacently corresponding rear end of the inner stator 21A.

In order to prevent a flux leakage to the front frame 110, it is preferred that the distance (L1) from the bottom of the step portion 112 and its corresponding front ends of the stators 21A and 21B is the same or longer than the interval (D2) of the air gap between the two stators 21A and 21B.

The spring unit 50 includes an inner spring 51 inserted in the axial direction of the piston 31 into the outer circumference of the cylinder 32 so that both ends thereof are respectively supported by the front face of the combining portion of the magnet support member 22A and the piston 31 and by the corresponding inner face of the front frame 110, and an outer spring 52 of which both ends are respectively supported by the rear face of the combining portion of the magnet support member 22A and the piston 31 and its corresponding front face of the rear frame 43.

Figure 6:
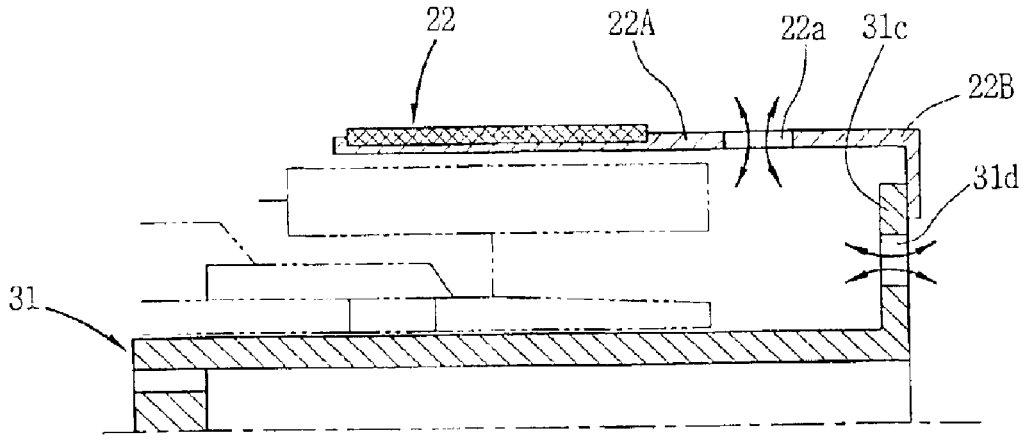
FIG. 6 is a schematic sectional view showing a major part of a modification of the reciprocating compressor in accordance with the preferred embodiment of the present invention.

With reference to FIG. 6, the flange part 31*c* is formed at the end of the rear side of the piston 31 so as to be combined with the magnet support member 22A of the armature 22. Gas holes 31*d* may be formed on the same circumference at equal intervals so that gas at both sides can be smoothly circulated.

Several gas holes 22*a* may be formed at the magnet support member 22A to reduce a flow resistance occurring at the rear side when the armature is moved reciprocally.

The same elements as those of the conventional art are given the same reference numerals.

The operational effect of the present invention will now be described.

When a power is applied to the winding coil 21C of the reciprocating motor 20, the armature 22 makes a reciprocal movement linearly along with the piston 31. As the piston 31 is moved reciprocally within the cylinder 32, the pressure of the compressive space 32*a* is varied, so that the coolant gas is sucked into the compressive space 32*a*, compressed up to a certain pressure and discharged. The series of processes are repeatedly performed.

A space (A) is formed around the front end portion of the armature 22 by the inner stator 21A, the outer stator 21B and the front frame 110, so that when the armature 22 is reciprocally moved, the pressure of the space (A) is heightened which may cause a flow resistance to the reciprocal movement of the armature.

In this respect, however, since gas holes 111 are formed at the front frame 110, when the armature 22 is moved forwardly, the gas filled in the space (A) is exhausted outside the compression unit 30 through the gas holes 111. Thus, a flow resistance to the reciprocal movement of the armature is reduced, so that the output-to-input of the motor can be increased, resulting in an improvement of the efficiency of the compressor.

FIG. 6 is a schematic sectional view showing a major part of a modification of the reciprocating compressor in accordance with the preferred embodiment of the present invention.

With reference to FIG. 6, gas holes 22*a* and 31*d* are respectively formed at the magnet support member 22A and the flange part 31*c* of the piston, the rear side of the armature 22, so that when the armature 22 is reciprocally moved, the gas filled inside and outside the armature freely flows to each other, and thus, a flow resistance due to the gas generated at the rear side of the armature 22 is reduced and an efficiency of the compressor is improved.

In case that an overstroke occurs that the armature 22 and the piston 31 forwards excessively due to a control error in reciprocal movement of the armature, there is a possibility that the front end portion of the armature 22 collides the inner face of the front frame 110. For such a case, as shown in FIG. 5B, the depth of the step portion 112 is suitably adjusted when formed at the front frame 110, such that before the front end portion of the armature 22 collides the inner face of the front frame 110, the combining portion of the armature 22 and the piston 31, that is, the flange part 31*c* of the piston, first collides the rear face of the inner stator 21A to limit the forward movement of the armature 21. Accordingly, the magnet 22B is prevented from releasing from the magnet support member 22A or damaging.

In addition, thanks to the step portion 112 of the front frame 110, the front frame 110 is positioned at a distance from each pool part of the inner stator 21A and the outer stator 21B even without extending the horizontal length of the compressor, so that the flux leakage through the front frame 110 is reduced and the efficiency of the reciprocating motor is improved.

A reciprocating motor in accordance with another embodiment of the present invention will now be described with reference to FIGS. 7 and 8.

Figure 7:
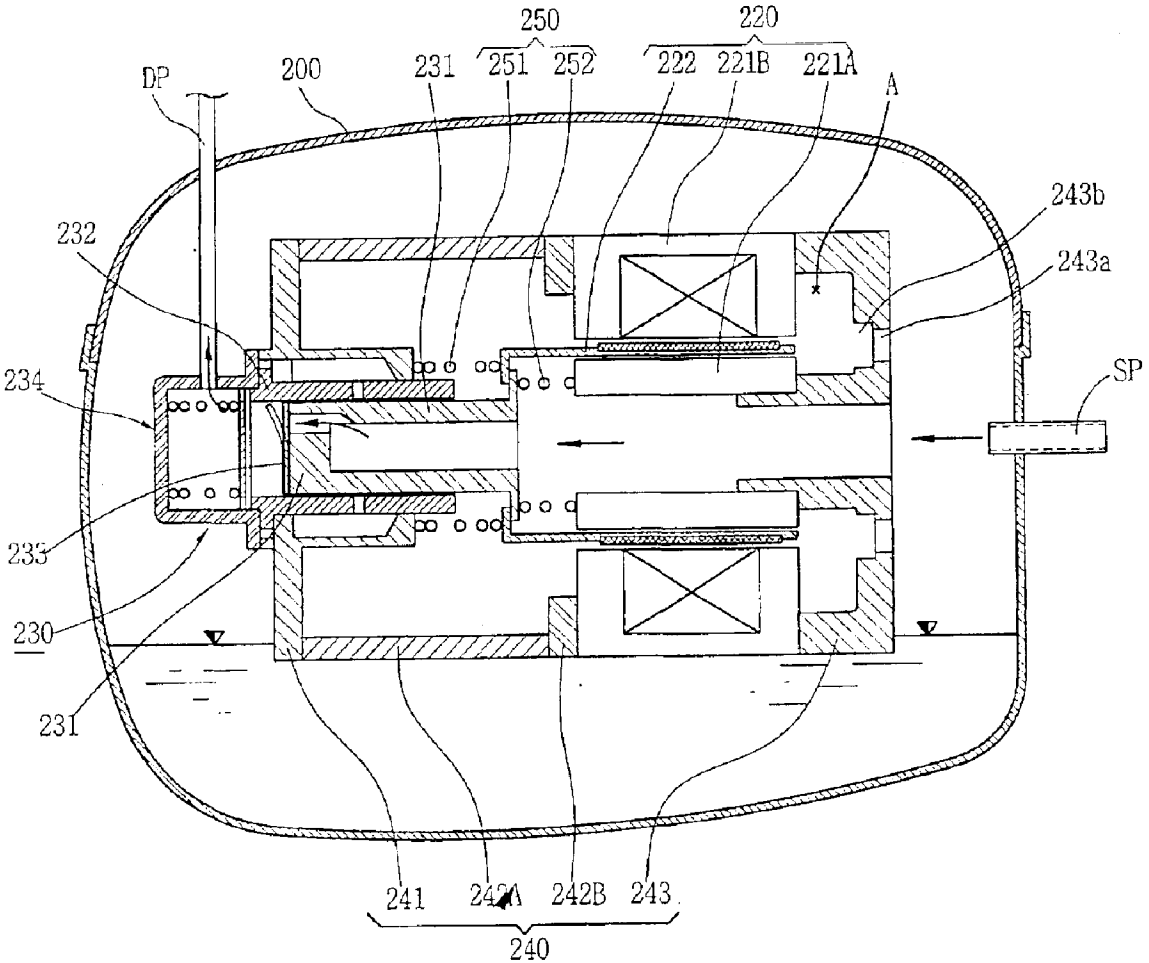
FIG. 7 is a vertical-sectional view showing another modification of the reciprocating compressor in accordance with the preferred embodiment of the present invention.
Figure 8:
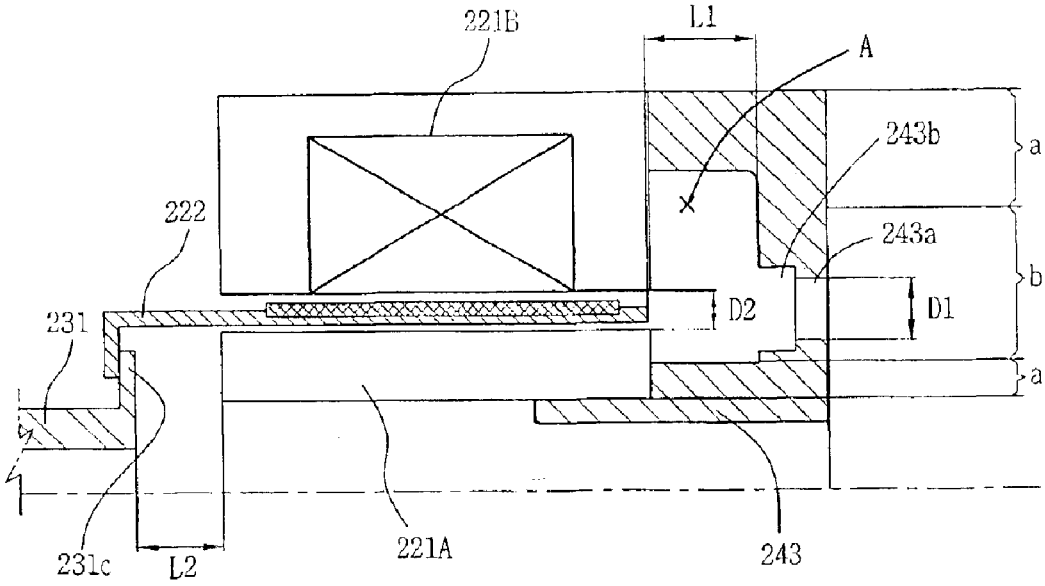
FIG. 8 is a vertical-sectional view showing a major part of the modification of the reciprocating compressor in accordance with the preferred embodiment of the present invention.

FIG. 7 is a vertical-sectional view showing another modification of the reciprocating compressor in accordance with the preferred embodiment of the present invention; and FIG. 8 is a vertical-sectional view showing a major part of the modification of the reciprocating compressor in accordance with the preferred embodiment of the present invention.

Unlike the above described example in which the reciprocating motor 20 is disposed outer circumference of the compression unit 30, in this modification, as shown in FIG. 7, a reciprocating motor 220 and a compression unit 230 are disposed at a predetermined interval in the forward and backward direction and mechanically connected and supported by a frame unit 240.

The frame unit 240 includes a front frame 241, a first and a second middle frames 242A and 242B and a rear frame 243.

A cylinder 232 into which a piston 231 is slidably inserted is fixed at the front frame 241.

An outer stator 221B of the reciprocating motor 220 is fixed between the second middle frame 242B and the rear frame 243, and a contact portion (a) is formed at the rear frame 243 by being supportedly contacted with the inner stator 221A and the outer stator 221B.

At the noncontact portion (b) corresponding in the movement direction of the armature 222 to the air gap between the inner stator 221A and the outer stator 221B, gas holes 243*a* having an inner diameter (D1) greater than the length (D2) of the air gap are formed on the same circumference.

A step portion 243*b* including gas holes 243*a* is formed concavely in a ring shape at the noncontact portion (b).

As for the depth of the step portion 243*b*, likewise in the above described example, it is preferred that the distance (L1) from the bottom of the step portion 243*a* to the rear end of the armature 222 is longer than the distance (L2) from the combining portion of the armature 222 and the piston 231, that is, the flange part 231*c*, to the front end of the inner stator 221A.

In this modification, a plurality of gas holes (not shown) may be formed at the flange part 231*c* of the piston 231 for combining the armature 222 and the piston 231 and at the magnet support member 222A.

In this manner, the space formed by the inner stator, the outer stator and the rear frame communicates with the outside through the gas holes, so that a flow resistance caused as the pressure in the space goes up during the reciprocal movement of the armature can be reduced.

In addition, in occurrence of an overstroke of the armature and the piston, thanks to the step portion of the rear frame, the combining portion of the armature and the piston first collides with the front end of the inner stator before the end portion of the armature collides with the inner face of the rear frame, preventing the armature from colliding. Thus the magnet is prevented from releasing or damaging and the reliability of the compressor is improved.

Moreover, since the interval between each stator and the rear frame is widened to a degree, the flux leakage is prevented through the rear frame, resulting in that the performance of the reciprocating motor is improved and the efficiency of the compressor is also improved.

As so far described, according to the reciprocating compressor of the present invention, the frame unit supporting the reciprocating motor and the compression unit includes at least one frame to support both the inner stator and the outer stator and the gas hole and the step portion are formed facing the air gap between the two stators.

Accordingly, when the armature of the reciprocating motor makes a reciprocal movement, the gas is compressed at the end of the armature, so that an increase of a flow resistance is prevented, and the efficiency of the compressor is heightened.

In addition, in occurrence of an overstroke of the armature, as the step portion makes a space to prevent the magnet from releasing or damaging, the reliability of the compressor is improved.

Moreover, the interval between the frame and each stator is widened to a degree to cut off a flux leakage, so that the efficiency of the compressor can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A reciprocating compressor comprising:

a closed container in which a suction pipe and a discharge pipe communicate with each other;

a reciprocating motor having a stator which consists of an inner stator and an outer stator fixed with a predetermined air gap inside the closed container and an armature disposed in the air gap between the two stators and making a reciprocal movement;

a compression unit having a piston combined with the armature of the reciprocating motor to make a reciprocal movement along with the armature and a cylinder fixed inside the closed container into which the piston is slidably inserted to form a compressive space;

a spring unit elastically supporting the armature of the reciprocating motor in a movement direction and inducing a resonance; and a frame unit supporting the reciprocating motor and the compression unit and having a gas hole at a suitable portion thereof to reduce gas flow resistance to movement of the armature, wherein the frame unit comprises at least one frame having a contact portion being supportedly contacted with the inner stator and the outer stator of the reciprocating motor, and the gas hole is formed at the frame having the contact portion.

2. The compressor of claim 1, wherein the gas hole is formed facing in the movement direction of the armature to the air gap between the inner stator and the outer stator.

3. The compressor of one of claim 1 or 2, wherein the inner diameter of the gas hole is the same or greater than the air gap of the reciprocating motor.

4. The compressor of claim 1, wherein the frame unit has a noncontact part with a step portion therein which does not contact each stator of the frame having the contact portion contacting both the inner stator and the outer stator.

5. The compressor of claim 4, wherein the step portion of the frame is formed facing in the movement direction of the armature to the air gap between the inner stator and the outer stator.

6. The compressor of claim 4, wherein the depth of the step portion is such that the distance from the bottom of the step portion to its corresponding end of the armature is longer than the distance from one face of the combining portion of the armature and the piston to the most adjacent corresponding end of the reciprocating motor.

7. The compressor of claim 4, wherein the depth of the step portion is such that the distance from the bottom of the step portion to the corresponding end of each stator is longer than the air gap between the two stators.

8. The compressor of claim 1 or 4, wherein a flange part is formed at the piston of the compression unit, so as to be combined with the armature of the reciprocating motor, and the gas hole is formed at the flange part of the piston.

9. The compressor of claim 1 or 4, wherein the gas hole is formed at the armature of the reciprocating motor.

10. A reciprocating compressor comprising:

a closed container in which a suction pipe and a discharge pipe communicate with each other;

a reciprocating motor having a stator which consists of an inner stator and an outer stator fixed with a predetermined air gap inside the closed container and an armature disposed in the air gap between the two stators and making a reciprocal movement;

a compression unit having a piston combined with the armature of the reciprocating motor to make a reciprocal movement along with the armature and a cylinder fixed inside the closed container into which the piston is slidably inserted to form a compressive space;

a spring unit elastically supporting the armature of the reciprocating motor in a movement direction and inducing a resonance; and a frame unit having a contact part simultaneously contacting each stator of the reciprocating motor to support the reciprocating motor and the compression unit and a noncontact concave part with a step portion therein.

* * * * *